US005799448A

United States Patent [19]

Dunk

[11] Patent Number: 5,799,448

[45] Date of Patent: Sep. 1, 1998

[54] ADJUSTABLE CLOSED-RISER METAL STAIRCASE SYSTEM

[75] Inventor: Robert Dunk, Brentwood, Tenn.

[73] Assignee: Harsco Corporation, Camp Hill, Pa.

[21] Appl. No.: 713,371

[22] Filed: Sep. 13, 1996

[51] Int. Cl.[6] ..... E04F 11/09

[52] U.S. Cl. ..... 52/188; 52/179

[58] Field of Search ..... 52/182, 183, 188, 52/190, 191, 179

[56] References Cited

U.S. PATENT DOCUMENTS

| | | | |
|---|---|---|---|
| 1,452,467 | 4/1923 | Lambert | 52/191 |
| 1,799,405 | 4/1931 | Bois | 52/191 |
| 3,978,628 | 9/1976 | Turner | 52/188 |
| 4,034,525 | 7/1977 | Yokomori | 52/191 |
| 5,357,724 | 10/1994 | Sonoda | 52/188 |

FOREIGN PATENT DOCUMENTS

| | | | |
|---|---|---|---|
| 522121 | 8/1953 | Belgium | 52/191 |

OTHER PUBLICATIONS

"Mebec Nosings and Stair Treads" by IKG Borden Published in Old Bridge, CT, USA on May 23, 1991.

*Primary Examiner*—Michael Safavi

*Attorney, Agent, or Firm*—Eckert Seamans Cherin & Mellott

[57] ABSTRACT

A closed-riser, adjustable rise, staircase system is provided which allows a plurality of stair treads to be assembled into staircases having different rise heights, for example, from six inches to seven inches, while maintaining the closed-riser nature of the staircase. The nose piece portion extending downwardly from the walking surface of each stair tread is dimensioned such that the distance to which it extends is greater than the desired range of adjustability of rise heights, and the riser portion of each stair tread is dimensioned such that, when positioned for the maximum desired rise height, an upper portion of the riser will continue to extend behind the nose piece of the stair tread positioned immediately above.

5 Claims, 3 Drawing Sheets

ADJUSTABLE CLOSED-RISER METAL STAIRCASE SYSTEM

BACKGROUND OF THE INVENTION

1. Field of the Invention

The present invention is directed to a closed-riser metal staircase system having stair treads that can be positioned at installation to set the rise between adjacent stairs at heights ranging from about 6 to 7 inches.

2. Description of Related Art

Slip resistant stair treads have heretofore been employed in industrial applications. A product marketed as a "Formed Steel MEBAC® Tread" has been available for such applications for longer than one year. MEBAC® is a registered trademark of Harsco Corporation, the assignee of the present application, for products having a certain type of slip-resistant surface. The MEBAC® slip-resistant flooring products are sold by the IKG Industries division of Harsco Corporation.

The prior art "Formed Steel MEBAC® Tread" was essentially a made-to-order stair tread which had a riser portion sized to meet the desired stair tread rise for a particular application, providing a closed riser stair tread system. If the desired rise was, for example, seven inches, the riser would be sized to extend upwardly from the stair tread for a distance of seven inches, less the distance that a front nose piece disposed at the front of the adjacent stair tread extended downwardly. In that manner, the riser would just close the rise or gap between the stair tread walking surface of a lower stair tread and the nose piece of the stair tread installed immediately above.

Two principal disadvantages are associated with such a system. First, because the desired rise between steps in a staircase will vary, the stair treads are "made to order", and production lead times are thus longer and manufacturing costs tend to be higher. In addition, the side brackets or stringers to which the stair treads are to be secured will generally have pre-drilled or tapped mounting holes that are occasionally out of tolerance. When the stair treads are then secured to the stringers, gaps can result between the risers and nose pieces of adjacent stair treads. The gaps detract from a neat appearance of the stairway, and in instances where the gaps are of substantial dimension, the gaps can lead to safety problems or concerns.

It is therefore a principal object of the present invention to provide a closed-riser stair tread system that avoids the above-noted disadvantages by providing a range of adjustment of the rise height, and by ensuring, at the maximum rise height, that the riser portion of one stair tread and the nose piece of an adjacent upper stair tread will continue to overlap.

SUMMARY OF THE INVENTION

The above and other objects of the present invention are achieved by providing a stair tread that has a nose piece portion at a front of a walking surface of the stair tread that extends downwardly for a length in excess of the distance desired for the range of adjustable rise height. The riser portion is likewise designed to be of a length slightly in excess of the maximum desired rise height for the stair system, less the length of the nose piece of the stair.

With the nose piece and riser portions being so dimensioned, it is then possible to move an upper and a lower stair tread relative to one another such that the riser of the lower stair tread extends behind the nose piece of the upper stair tread, within the predetermined range of adjustability. The stair treads may then be secured in the known manner to opposing stringers in forming the closed riser staircase.

DETAILED DESCRIPTION OF THE PREFERRED EMBODIMENT

Figure 1:
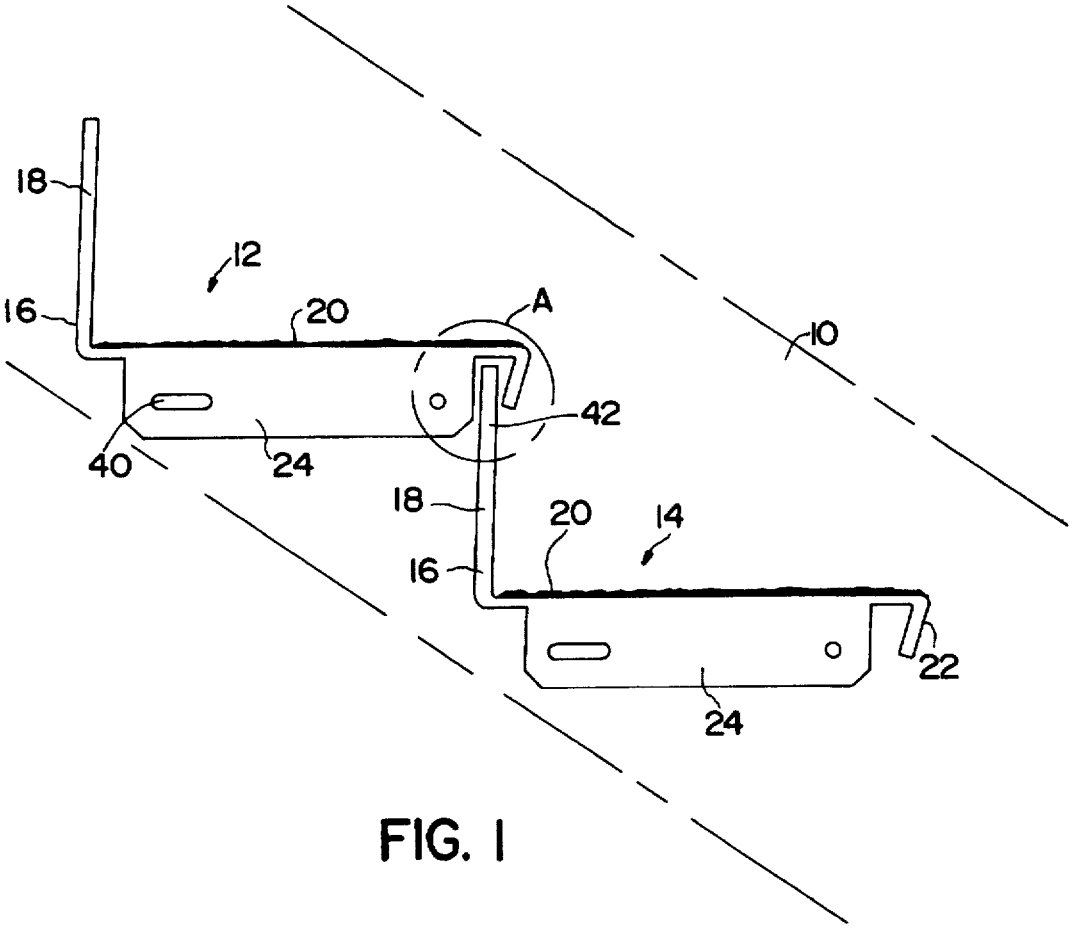
FIG. 1 is a side elevation view of two stair treads arranged in an upper and lower stair tread configuration.

Looking at the figures illustrating the staircase system of the present invention it is seen that the staircase system is of the type generally having a pair of stringers 10 made of steel plate, and having bores 11 pre-drilled therein to make bolt-through connections to retain the stair treads in position once the stair system is assembled. The stair treads 12, 14 are preferably made from a single piece of steel plate 16 that is formed into the stair tread by bending the plate.

A riser portion 18 is bent to form substantially a right angle with the walking surface 20. The walking surface 20 preferably has a slip-resistant surface, for example, a MEBAC® coating of thermally sprayed steel encapsulating a dispersion of grit particles, normally aluminum-oxide grit particles. The process for forming a MEBAC® slip-resistant surface is disclosed in U.S. Pat. No. 4,029,852, issued to Maximillian Palena, which patent is expressly incorporated herein by reference.

A nose piece 22 of the stair tread 12 is formed at the front of the stair by bending the forward portion of the steel plate downwardly, preferably through a greater than 90° bend. Stringer attachment brackets 24 are disposed on each side of the stair tread 12, and are preferably formed by bending down two tab-like portions formed on the steel plate 16, substantially at right angles to the walking surface 20. The attachment stringers 24 include an elongated opening 40 and an aperture 42 through which fasteners are placed to fix the stair treads 12 and 14 to the stringers 10. Elongated opening 40 allows for horizontal movement of the stair treads 12 and 14 after a fastener has been placed through opening 40. A stair tread 12 or 14 is secured to the stringers 10 by placing a fastener through elongated opening 40 so that the fastener slides within elongated opening 40. In this manner, the stair treads 12 and 14 can be positioned along stringers 10 to insure that the nose piece of upper stair tread 12 does not overlap the walking surface 20 of the lower stair tread 14. Once the stair treads 12 and 14 are in proper horizontal relation a fastener is placed through aperture 42 fixing the stair treads 12 or 14 in place. In the prior art "Formed Steel MEBAC® Tread", the stringer attachment brackets were formed separately from sheet or bar stock, and were welded into position once the stair tread was formed.

The vertical distance between walking surfaces 20 of adjacent stair treads 12 and 14 is known as the rise height of the stair. Typically, stair treads are manufactured in order to meet a pre-determined or desired rise height. This rise height is solely determined by the height of the riser portion of the stair tread. During installation, a stair tread is fastened between the two stringers and the next stair tread is inserted so that either the walking surface of the stair tread or the bottom of the nose piece, depending upon the type of stair tread, is in contact with the top of the riser portion. In order to obtain the desired rise height, each riser portion of the stair tread must be appropriately sized. Any defects in manufacturing or errors in installing the stair tread will cause gaps to form between adjacent stair treads or variations in the desired rise height.

With the stair treads 12, 14 of the present invention, the rise between stairs in the finished staircase is not fixed at a single height based on a made-to-order fabrication, but rather, may be set within a range of heights, depending upon the specific application and installation, while still maintaining the closed riser nature of the staircase system. This is accomplished by dimensioning the nose piece portion 22 of the stair tread 12 and the riser portion 18 of the stair tread such that a riser portion 18 of a lower stair tread 14 can be moved through a vertical distance behind the nose piece 22 of the stair tread 12 above and immediately adjacent the lower stair tread. The distance the riser portion 18 of the stair tread 14 can be moved relative to the nose piece 22 of the stair tread 12 is known as the rise height adjustment distance. In particular, the rise height adjustment distance is defined as the vertical distance riser portion 18 can be moved relative to nose piece 22 wherein the riser 18 and nose piece 22 will remain in overlapping relation to each other. Usually this distance ranges between a maximum rise height and a minimum rise height. The maximum rise height is the greatest rise height distance which can be achieved wherein riser portion 18 is overlapped by nose piece 22. The minimum rise height is the rise height when the top of riser portion 18 abuts the top of nose piece 22.

Figure 2:
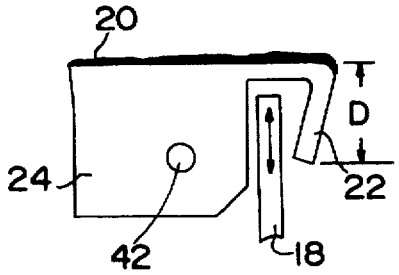
FIG. 2 is an enlarged view of area A designated in FIG. 1.
Figure 3:
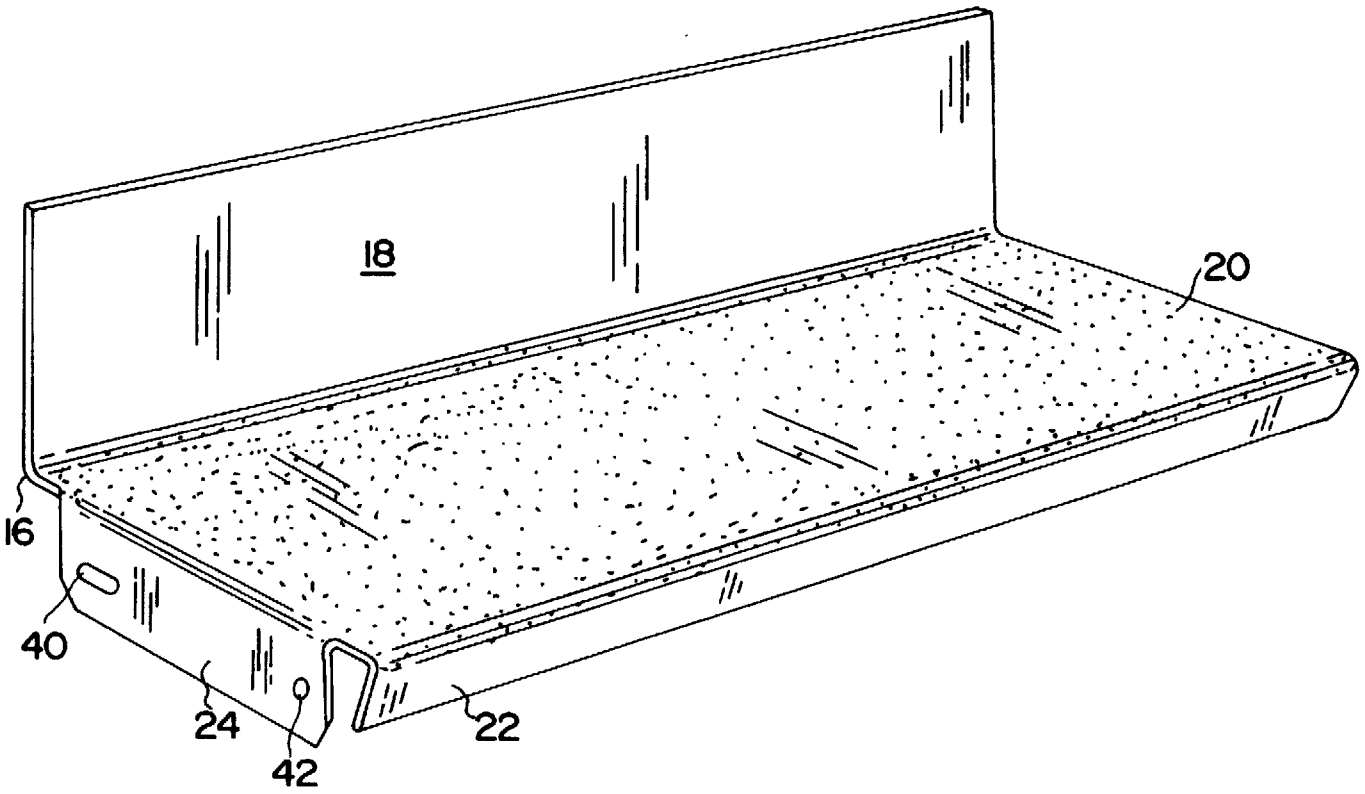
FIG. 3 is a perspective view of a stair tread in accordance with the preferred embodiment of the present invention.
Figure 4:
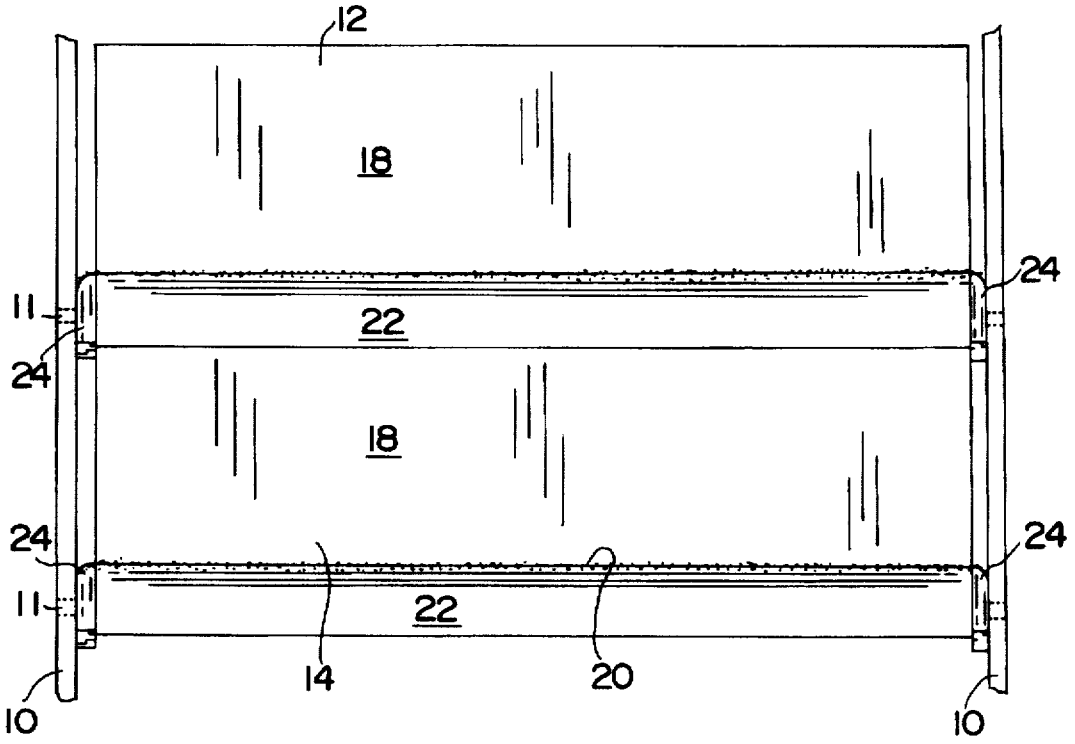
FIG. 4 is a front elevation view of first and second stair treads fastened to opposing stringers in forming a part of a staircase.

The nose piece 22 thus is formed to extend downwardly from the walking surface 20 of the stair tread for a distance at least equal to, and preferably slightly greater than, the desired range of adjustability of the rise height in the staircase system. For example, in the principal expected industrial applications for this product, the range of desired rise heights would span about one inch, from six inches to seven inches. In this situation, the nose piece preferably extends downwardly from the walking surface to about 1¾ inches below the walking surface as designated by distance D in FIG. 2.

The riser portion 18 of the lower stair tread 14 is also sized to properly accommodate the desired rise heights and range of rise heights for the system. For example, with the desired adjustability from a six to a seven inch rise as discussed above, the riser preferably extends upwardly from the walking surface approximately 5¾ inches. This allows the stair treads 12, 14 to be moved to the minimum desired six-inch rise, and also extended to the desired maximum seven-inch rise. With the stair tread so dimensioned, the riser portion 18 of the lower stair tread 14 and the nose piece 22 of the upper stair tread 12 will continue to overlap, even at the seven-inch maximum rise, thus retaining the closed-riser nature of the staircase system. It will be recognized and understood within the level of skill in the art that if a greater or lesser range of adjustability between a desired minimum and maximum rise is desired, the nose piece portions 22 and riser portions 18 can be dimensioned accordingly.

The stair treads of the present invention are preferably manufactured to substantially identical dimensions for a given staircase system having a predetermined or defined minimum and maximum desired rise height. In that manner, the stair treads may be used as both lower stair treads and upper stair treads in the same system at the same time, as is logical in forming staircases having a plurality of stair treads.

The stair treads 12, 14 will typically be made of carbon steel plate of 3/16" thickness, but other materials and material thicknesses may be employed as well. Further, although the walking surfaces 20 of the stair treads 12, 14, preferably have a MEBAC® slip-resistant coating applied thereto, other slip-resistant coatings may be used, and other manners, such as by selection of materials, by which to achieve a desired level of slip-resistance may be employed.

While the invention has been particularly shown and described with reference to a preferred embodiment thereof, it will be understood by those skilled in the art that changes may be made to the preferred embodiment without departing from the spirit and scope of the invention. Accordingly, the scope of the invention is to be determined by reference to the appended claims.

What is claimed is:

1. A closed riser metal staircase installed to match a predetermined rise height distance said rise height distance having a range between a predetermined minimum rise height distance and a predetermined maximum rise height distance said range of distances defining a predetermined rise height adjustment distance substantially equal to one inch, said staircase comprising:

at least one upper stair tread member having a coated slip-resistant walking surface and being bent from a single piece of metallic material to form a slanted nose piece extending downwardly from a front edge of the walking surface and having first and a second attachment brackets extending downwardly from a left and a right side of said walking surface, said first and second brackets having an elongated opening and an aperture for receiving an attachment means for fixing said upper stair tread to a frame, said bracket allowing for horizontal adjustment of said stair tread on said frame and, at least one lower stair tread member having a coated slip-resistant walking surface and being bent from a single piece of metallic material to form a riser portion extending upwardly along a rear edge of said walking surface and having a first and a second attachment bracket extending downwardly from a left and a right side of said walking surface, said brackets having an elongated opening and an aperture for receiving an attachment means for fixing said lower stair tread to a frame, said elongated opening allowing for horizontal adjustment of said stair tread on said frame;

said at least one upper and at least one lower stair tread members being arranged so that said upwardly extending riser is fitted underneath and is adjustable vertically, without affecting the horizontal orientation between the nose piece of the upper stair tread and the walking surface of the lower stair tread, relative to said downwardly extending nose piece so that said at least one upper and lower stair tread members form a lower stair and an upper stair;

wherein said nose piece extends from said at least one upper stair tread member a distance which exceeds said predetermined rise height adjustment distance and said riser portion extends upwardly from said at least one lower stair tread member a distance which exceeds the predetermined maximum rise height distance less the distance said nose piece extends from said upper stair tread member, and wherein said riser portion of said lower stair tread member extends upwardly from said walking surface of said lower stair tread a height no greater than said predetermined minimum rise height distance.

2. The closed-riser metal staircase as recited in claim 1, wherein said frame comprises a left stringer and a right stringer, said at least one upper and at least one lower stair tread members being secured at their sides to said left and right stringers.

3. The closed-riser metal staircase as recited in claim 1, wherein said predetermined minimum rise height distance is six inches, and said predetermined maximum rise height distance is seven inches.

4. The closed-riser metal staircase as recited in claim 1, wherein the nose piece of said at least one upper stair tread member extends downwardly from said walking surface of said at least one upper stair tread member to a distance of 1¾ inches, and wherein said riser portion of said at least one upper stair tread member extends upwardly from said walking surface to a distance of 5¾ inches.

5. The closed-riser staircase recited in claim 1, wherein said at least one upper and said at least one lower stair tread members comprises of carbon steel.

* * * * *